US005669465A

United States Patent [19]

Kulak et al.

[11] Patent Number: 5,669,465

[45] Date of Patent: *Sep. 23, 1997

[54] ELEVATOR HOISTWAY DOOR BOLT LOCK

[75] Inventors: Richard E. Kulak, Bristol; Thomas M. McHugh, Farmington, both of Conn.; Edward E. Ahigian, Chicago, Ill.; Jerome F. Jaminet, South Windsor, Conn.; Thomas He, Unionville, Conn.; Richard E. Peruggi, Glastonbury, Conn.; Thomas M. Kowalczyk, Farmington, Conn.; David W. Barrett, East Hartland, Conn.

[73] Assignee: Otis Elevator Company, Farmington, Conn.

[ * ] Notice: The term of this patent shall not extend beyond the expiration date of Pat. No. 5,454,447.

[21] Appl. No.: 508,936

[22] Filed: Jul. 28, 1995

Related U.S. Application Data

[63] Continuation-in-part of Ser. No. 223,522, Apr. 6, 1994, Pat. No. 5,454,447.

[51] Int. Cl.[6] ..... B66B 13/02

[52] U.S. Cl. ..... 187/331; 187/335; 187/336

[58] Field of Search ..... 187/331–335, 187/336

[56] References Cited

U.S. PATENT DOCUMENTS

| | | | |
|---|---|---|---|
| 964,891 | 7/1910 | Westlin . | |
| 1,248,516 | 12/1917 | Lutz | 187/331 |
| 1,350,698 | 8/1920 | Boedtcher | 187/331 |
| 1,679,092 | 7/1928 | McCormick . | |
| 1,709,970 | 4/1929 | Brubaker . | |
| 1,882,621 | 10/1932 | Ives . | |
| 2,307,542 | 1/1943 | Prince | 187/331 |
| 4,364,454 | 12/1982 | Glaser et al. | 187/57 |
| 4,483,420 | 11/1984 | Byrne | 187/331 |
| 5,139,112 | 8/1992 | Tonna et al. | 187/49 |
| 5,203,431 | 4/1993 | Donohoe, et al. | 187/31 |
| 5,207,298 | 5/1993 | Donohoe et al. | 187/31 |
| 5,454,447 | 10/1995 | Kulak et al. | 187/331 |

FOREIGN PATENT DOCUMENTS

| | | | |
|---|---|---|---|
| 405132275A | 5/1993 | Japan | 187/331 |
| 430028 | 11/1974 | Russian Federation . | |

*Primary Examiner*—David H. Bollinger
*Assistant Examiner*—Khoi H. Tran

[57] ABSTRACT

An elevator hoistway door lock assembly comprises first and second lock subassemblies. Each lock subassembly has a rotatable latch mounted on a respective door hanger, a first and second catches are mounted on the hoistway for engagement with each respective latch, a first and second cam followers are fastened to the respective latches and movable between a first position in which each latch engages the respective catch in a locked position and a second position in which each latch is disengaged from the respective catch in an unlocked position so that the hoistway doors may be moved to an open position and each pair of electrical contacts for indicating a locked condition of the respective door when the contacts are electrically connected.

7 Claims, 2 Drawing Sheets

FIG. 1
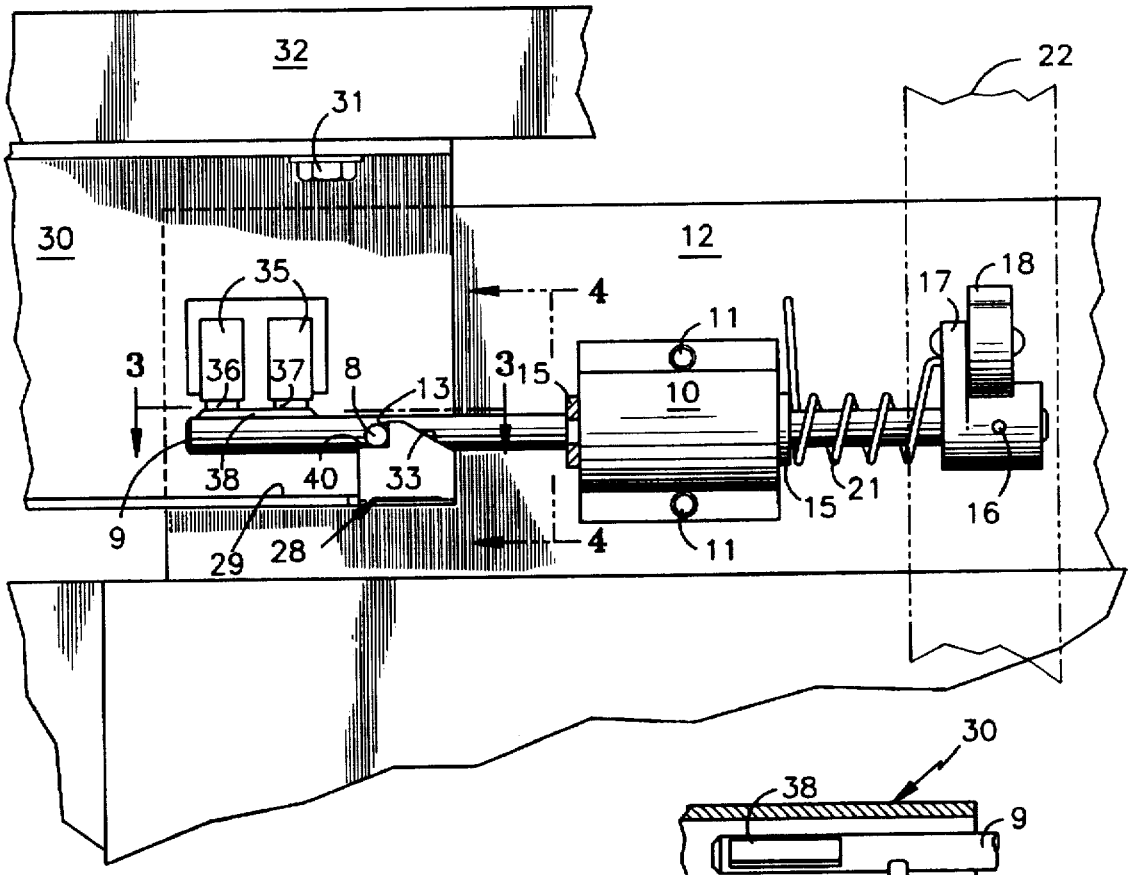
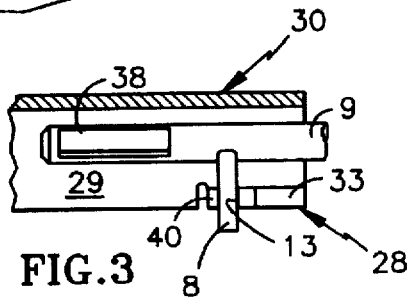
FIG. 3
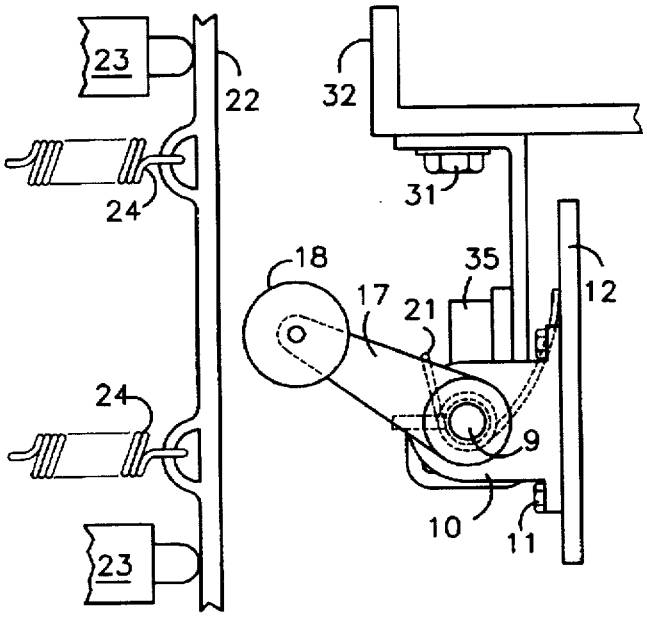
FIG. 2
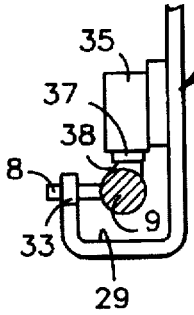
FIG. 4
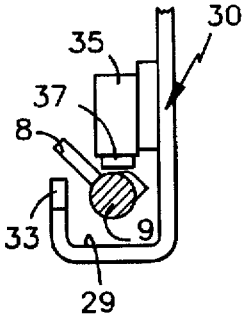
FIG. 5

ELEVATOR HOISTWAY DOOR BOLT LOCK

CROSS REFERENCE

This application is a continuation-in-part of U.S. Ser. No. 08/223,522, U.S. Pat. No. 5,454,447, entitled Elevator Hoistway Door Bolt Lock filed Apr. 6, 1994.

TECHNICAL FIELD

This invention relates to a lock for securing two elevator hoistway doors firmly in the closed position, except when unlocked by an adjacent elevator car to permit transfer of passengers between the car and the adjacent landing.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the landing doors in unison therewith, thereby protecting passengers in the car from the building structure and protecting passengers at the landing from the hoistway.

For safety reasons, and to comply with safety codes, wherever an elevator car is not adjacent to a landing, the hoistway doors must be safely locked in the closed position. One known type of door lock has a rotatable latch that engages a lip, the latch being rotated by a vane on the adjacent elevator car door, as the car door begins to move toward the open position. This type of lock, however, is useful only in a lost motion door coupling system (that is one in which the car door begins to move before it moves the hoistway door). For systems in which lost motion car door coupling is not permitted, because the resulting perturbations in the door operating systems are to be avoided, the vane rotated latch cannot be used. Any mechanisms related to the elevator doors must not interfere with the passage of an elevator past the landing at relatively high speed.

A type of hoistway door lock which can unlock the hoistway door before elevator car door motion occurs utilizes a retiring cam. The retiring cam is mounted on the elevator car and is forced toward the hoistway door as soon as the car approaches the landing sufficiently close so as to begin advance door opening. The retiring can rotates a member mounted on the hoistway header to unlock the hoistway door prior to any motion of the car door. However, such systems typically lock only one of the hoistway doors directly to the hoistway header or other building structure, and cause the other hoistway door to be locked thereto by a related mechanism of some form. Other devices of this type may require use of a very long rotating member which introduces installation and maintenance problems due to the requirement for critical alignment. It would be desirable to have a locking system which locks both hoistway doors directly to the hoistway header or other building structure.

DISCLOSURE OF INVENTION

Objects of the invention include provision of a relatively simple, positive, hoistway door lock assembly for directly locking both hoistway doors which may be used in systems that do not employ lost motion, which are simple to install and require little maintenance, and which allow self-closure and locking in the absence of the elevator car.

According to the present invention, an elevator hoistway door lock assembly comprises first and second lock subassemblies. The first lock subassembly has a first rotatable latch mounted on a first door hanger, a first catch mounted on the hoistway for engagement with the first latch, a first cam follower fastened to the first latch and movable between a first position in which the first latch engages the first catch in a locked position and a second position in which the first latch is disengaged from the first catch in an unlocked position so that the first hoistway door may be moved to an open position and a first pair of electrical contacts for indicating a locked condition of the first door when the contacts are electrically connected. The second lock subassembly has a second rotatable latch mounted on a second door hanger, a second catch mounted on the hoistway for engagement with the second latch, a second cam follower fastened to the second latch and movable between a first position in which the second latch engages the second catch in a locked position and a second position in which the second latch is disengaged from the second catch in an unlocked position so that the second hoistway door may be moved to an open position and a second pair of electrical contacts for indicating a locked condition of the second door when the contacts are electrically connected.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a side elevation view of an elevator hoistway door lock in accordance with the present invention.

FIG. 2 is a side elevation view of the elevator door lock of FIG. 1.

FIG. 3 is a partial, partially sectioned top view taken on the line 3—3 of FIG. 1.

FIG. 4 is a partial, partially sectioned side elevation view taken on the line 4—4 of FIG. 1.

FIG. 5 is a partial, partially sectioned side elevation view in the unlocked position.

BEST MODE FOR CARRYING OUT THE INVENTION

Figure 6:
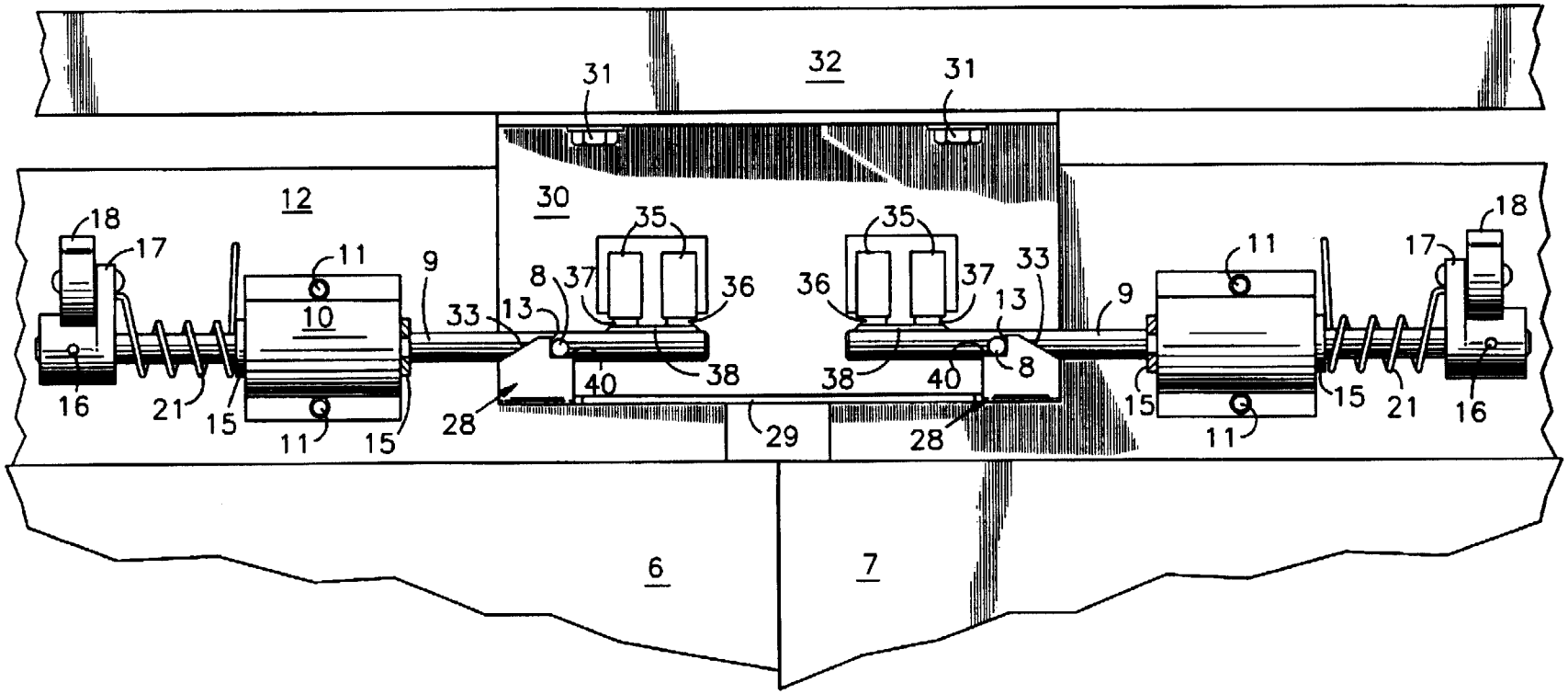
FIG. 6 is a side elevation view of a dual hoistway door lock assembly in accordance with the present invention.

Referring to FIG. 1, a pair of elevator hoistway doors 6, 7 are shown in the closed position, in which they must be locked for safety. A lock in accordance with the present invention comprises a latch having a pin 8 extending laterally from a rod 9 that is journaled for rotation in a pillow block 10 that is secured by bolts 11 to a hoistway door hanger 12. The door hanger mounts rollers (not shown) which ride on a door track (not shown) attached to the hoistway. The pin 8 engages a catch or lip 13 when locked. The rod 9 may be held in place with respect to the pillow block 10 by means of retaining rings 15. The rod 9 is secured, such as by a pin or screw 16, to a cam follower arm 17 to which a cam follower roller 18 is disposed for rotation. As shown in FIG. 2, the weight of the follower 17 and roller 18, together with a spring 21, ensures that the follower 17 will always remain in the position shown in FIGS. 1 and 2, thereby ensuring that the rod 9 will be in the position shown in FIGS. 1, 3 and 4, except when it is rotated clockwise (as seen in FIG. 2) by a retiring cam 22. If the weight of the follower 17 and roller 18 is sufficient to ensure return to the locked position, the spring 21 may be eliminated. Normally, the spring 21 will not be used. The retiring cam 22, shown dotted in FIG. 1 and only schematically in FIG. 2, is capable of being moved to the right (as seen in FIG. 2) by means of solenoid actuators 23, and to be automatically returned to the position shown in FIG. 2 by means of springs 24; the retiring cam 22 may be operated in any other known way.

When the elevator car is not within the landing zone (within which the doors are not allowed to be opened), the solenoid actuators 23 will not be actuated, causing the retiring cam to be in a clearance position as shown in FIG. 2. When the car enters the landing zone, the actuators 23 will move the retiring cam 22 to the right, thereby rotating the rod 9 through about 45° in the clockwise direction. Because the car door engages the hoistway door by means of a coupling mechanism so that the car door will move the hoistway door open and closed in unison with it, the retiring cam 22 will remain engaged with the cam follower roller 18, throughout the door motion, thus retaining the pin 8 in the unlocked position, until, after the doors are closed, the retiring cam 22 is retired.

After passenger transfer, when the doors are fully closed, the retiring cam will again be allowed to be returned to the position shown in FIG. 2 by deactivation of the solenoid actuators 23, under the urging of the springs 24. The actuators 23 and springs 24 are secured to the elevator car (not shown, to the left of FIG. 2).

When in the locked position as shown in the figures, the pin 8 engages the lip 13 (FIGS. 1, 2 and 4) formed in a wall 28 which extends upwardly from a shelf 29 on a switch and lock assembly 30 that is supported by bolts 31 from the hoistway header 32. The wall 28 also has a ramp surface 33 that will raise the pin whenever the hoistway door is closing without the aid of the retiring cam 22, as in maintenance operations. Such action allows automatic door closures, such as by a weight, and automatic locking, as required by government codes. The assembly 30 also supports electrical switch contact holders 35 which position electrical contacts 36, 37 near the rod 9 so that current will flow between them through a rotating contact 38 only when the rod is in the locked position as shown. The electrical contacts 36, 37 are connected to an electrical circuit which sends a signal to a controller when electrical contacts 36, 37 are electrically connected by contact 38 to indicate that the door is properly locked and it is therefor safe to move the elevator car. The wall 28 may also have a shelf 40 formed therein to act as a stop and hold the rod 9 in the correct rotation when the door is locked.

As evident in FIG. 5, when the retiring cam 22 rotates the follower arm so that the rod 9 is rotated clockwise by about 45°, the pin 8 will clear the lip 13 and the rotating contact 38 will no longer connect the switch contacts 36, 37.

Referring to FIG. 6, a dual lock assembly is shown where hoistway doors 6, 7 are each directly locked to the hoistway door header 32. The lock assembly for hoistway door 6 is the mirror image of the lock assembly for hoistway door 7 previously described in detail relative to FIG. 1 with like numerals being used to identify like parts. Accordingly, both hoistway doors can be directly locked to the hoistway door header and the locked condition of each door can be separately indicated to the elevator controller. Because the operation of each lock assembly is identical to that described relative to FIG. 1, further explanation is not required.

The foregoing embodiments are exemplary merely, there being many details which can be altered to suit any implementation of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. In an elevator hoistway door assembly having a first hoistway door with a first door hanger at the top thereof and a second hoistway door with a second door hanger at the top thereof, a door lock assembly for directly locking both the first and second hoistway doors to the hoistway comprising:

a first lock assembly having a first rotatable latch mounted on said first door hanger, a first catch mounted on said hoistway for engagement with said first latch, a first cam follower fastened to said first latch and movable between a first position in which said first latch engages said first catch in a locked position and a second position in which said first latch is disengaged from said first catch in an unlocked position so that said first hoistway door may be moved to an open position and a first pair of electrical contacts for electrically indicating a locked condition of said first door when said contacts are electrically connected and a second lock assembly having a second rotatable latch mounted on said second door hanger, a second catch mounted on said hoistway for engagement with said second latch, a second cam follower fastened to said second latch and movable between a first position in which said second latch engages said second catch in a locked position and a second position in which said second latch is disengaged from said second catch in an unlocked position so that said second hoistway door may be moved to an open position and a second pair of electrical contacts for electrically indicating a locked condition of said second door when said contacts are electrically connected;

said first catch comprises a first lip disposed on a hoistway in the vicinity of said first hoistway door at an elevator landing doorway;

said first latch comprises a first rod journaled for rotation on the first hoistway door in the vicinity of said first lip and a first pin extending laterally outward from said first rod in a position so as to be able to engage said first lip when said first hoistway door is in the closed position and thereby prevent said first hoistway door from moving toward the open position;

said first cam follower being fastened to said first rod and movable between a first position in which said first rod is rotated to a locked position in which said first pin engages said first lip and an unlocked position in which said first pin clears said first lip so that said first hoistway door may be moved toward an open position, said first cam follower being disposed in a position adjacent to the position at which a retiring cam of an elevator car will appear when the elevator car is within a landing zone of a landing to which said first hoistway door corresponds, whereby, when an elevator car is within the landing zone of the related landing, the retiring cam may actuate said first cam follower to rotate said first rod into said unlocked position;

said second catch comprises a second lip disposed on a hoistway in the vicinity of said second hoistway door at an elevator landing doorway;

said second latch comprises a second rod journaled for rotation on the second hoistway door in the vicinity of said second lip and a second pin extending laterally outward from said second rod in a position so as to be able to engage said second lip when said second hoistway door is in the closed position and thereby prevent said second hoistway door from moving toward the open position; and said second cam follower being fastened to said second rod and movable between a first position in which said second rod is rotated to a locked position in which said second pin engages said second lip and an unlocked position in which said second pin clears said second lip so that said second hoistway door may be moved toward an open position, said second cam follower being disposed in a position adjacent to the position at which a retiring cam of an elevator car will appear when the elevator car is within the landing zone of the landing to which said second hoistway door corresponds, whereby, when an elevator car is within the landing zone of the related landing, the retiring cam may actuate said second cam follower to rotate said second rod into said unlocked position.

2. The assembly of claim 1 wherein said first and second catches are mounted on a hoistway door header secured to the hoistway.

3. The assembly of claim 1 comprising:

said first pair of electrical contacts being displaced longitudinally of each other adjacent to said first rod;

a first rotating electrical contact extending outwardly from the periphery of said first rod and having a limited arcuate extent, said first contact disposed on the periphery of said first rod so that when said first rod is rotated into the locked position with said first pin engaging said first lip said first rotating contact will electrically interconnect said first pair of electrical contacts, said first rotating electrical contact being of limited arcuate extent so that when said first rod is rotated into said unlocked position with said first pin clearing said first lip, said first pair of electrical contacts are not interconnected by said first rotating electrical contact, said second pair of electrical contacts being displaced longitudinally of each other adjacent to said second rod; and a second rotating electrical contact extending outwardly from the periphery of said second rod and having a limited arcuate extent, said second contact disposed on the periphery of said second rod so that when said second rod is rotated into the locked position with said first pin engaging said second lip said second rotating contact will electrically interconnect said second pair of electrical contacts, said second rotating electrical contact being of limited arcuate extent so that when said second rod is rotated into said unlocked position with said second pin clearing said second lip, said second pair of electrical contacts are not interconnected by said second rotating electrical contact.

4. The assembly of claim 3 wherein said first and second pairs of electrical contacts and said first and second lips are mounted to a hoistway door header secured to the hoistway.

5. The assembly of claim 1 comprising:

a first spring acting between said first cam follower and said first hoistway door so as to resiliently urge said first cam follower to rotate said first rod into said locked position, and a second spring acting between said second cam follower and said second hoistway door so as to resiliently urge said second cam follower to rotate said second rod into said locked position.

6. The assembly of claim 1 wherein:

said first cam follower is disposed to rotate under its own weight when not actuated by said retiring cam, thereby to rotate said first rod into said locked position, and said second cam follower is disposed to rotate under its own weight when not actuated by said retiring cam, thereby to rotate said second rod into said locked position.

7. The assembly of claim 1 wherein:

said first lip is in a first wall having a first ramp surface that raises said first pin over said first lip wherever the first hoistway door is closed with said first cam follower not being rotated into said unlocked position by the retiring cam, and said second lip is in a second wall having a second ramp surface that raises said second pin over said second lip whenever the second hoistway door is closed with said second cam follower not being rotated into said unlocked position by the retiring cam.

* * * * *